US011428394B2

(12) United States Patent
Clawson et al.

(10) Patent No.: US 11,428,394 B2
(45) Date of Patent: Aug. 30, 2022

(54) LIGHT BOARD FOR LIGHTING FIXTURE

(71) Applicant: Hubbell Lighting, Inc., Shelton, CT (US)

(72) Inventors: Thomas N. Clawson, Boiling Springs, SC (US); Derek Bruce Baker, Middleborough, MA (US)

(73) Assignee: Hubbell Lighting, Inc., Shelton, CT (US)

( * ) Notice: Subject to any disclaimer, the term of this patent is extended or adjusted under 35 U.S.C. 154(b) by 0 days.

(21) Appl. No.: 17/182,889

(22) Filed: Feb. 23, 2021

(65) Prior Publication Data

US 2021/0180781 A1 Jun. 17, 2021

Related U.S. Application Data

(63) Continuation of application No. 15/963,350, filed on Apr. 26, 2018, now Pat. No. 10,928,046.
(Continued)

(51) Int. Cl.
*F21V 23/00* (2015.01)
*H05B 45/00* (2022.01)
(Continued)

(52) U.S. Cl.
CPC ..... *F21V 23/005* (2013.01); *H05B 45/46* (2020.01); *F21V 29/70* (2015.01); *F21Y 2103/10* (2016.08);
(Continued)

(58) Field of Classification Search
CPC ..... F21V 23/00; F21V 23/003; F21V 23/004; F21V 23/005; F21V 23/007;
(Continued)

(56) References Cited

U.S. PATENT DOCUMENTS 6,379,022 B1 4/2002 Amerson et al.
7,002,546 B1 2/2006 Stuppi et al.
(Continued)

FOREIGN PATENT DOCUMENTS

CA 2897344 6/2016
CA 2969102 7/2020

OTHER PUBLICATIONS

GRE Alpha LED Power Specialists, XS Switch Dim "Momentary Switch Dimming Module," Product Spec. Sheet, 2017—4 pages.

*Primary Examiner* — Thai Pham
(74) *Attorney, Agent, or Firm* — Michael Best & Friedrich LLP

(57) ABSTRACT

Light boards including one or more light emitting elements (e.g. light emitting diode (LED) devices) for use in lighting fixtures are disclosed. In one example implementation, a light board includes a first layer having a first surface and an opposing second surface. The light board includes one or more light emitting elements disposed on the first surface of the first layer. The light board includes one or more circuit elements located on the second surface of the first layer. The one or more circuit elements are associated with powering the one or more light emitting elements. The light board includes a second layer disposed on the second surface of the first layer such that the one or more circuit elements are located between the second surface of the first layer and the second layer.

24 Claims, 7 Drawing Sheets

Related U.S. Application Data

(60) Provisional application No. 62/501,903, filed on May 5, 2017.

(51) Int. Cl.

| | |
|---|---|
| ***H05B 45/46*** | (2020.01) |
| *F21V 29/70* | (2015.01) |
| *F21Y 113/13* | (2016.01) |
| *F21Y 103/10* | (2016.01) |
| *F21Y 115/10* | (2016.01) |

(52) U.S. Cl.
CPC ..... *F21Y 2113/13* (2016.08); *F21Y 2115/10* (2016.08)

(58) Field of Classification Search
CPC .... F21V 29/508; F21V 29/70; F21Y 2115/00; F21Y 2115/10; H05B 45/00; H05B 45/46
See application file for complete search history.

(56) References Cited

U.S. PATENT DOCUMENTS

| | | | | |
|---|---|---|---|---|
| 7,800,566 | B2 | 9/2010 | Ha et al. | |
| 7,902,771 | B2 | 3/2011 | Shteynberg et al. | |
| 8,203,276 | B2 | 6/2012 | Shackle et al. | |
| 8,294,379 | B2 | 10/2012 | Liu | |
| 8,552,662 | B2 | 10/2013 | Sun et al. | |
| 8,629,629 | B2 | 1/2014 | Hariharan | |
| 8,653,751 | B2 | 2/2014 | Shimizu et al. | |
| 8,829,804 | B2 | 9/2014 | Radermacher | |
| 9,538,604 | B2 | 1/2017 | Yadav et al. | |
| 9,907,134 | B2 | 2/2018 | Yadav et al. | |
| 2005/0007035 | A1 | 1/2005 | Sloan et al. | |
| 2006/0273331 | A1 | 12/2006 | Lim et al. | |
| 2007/0159008 | A1 | 7/2007 | Bayat et al. | |
| 2008/0111944 | A1 | 5/2008 | Sakai | |
| 2009/0226656 | A1* | 9/2009 | Crandell | H05K 1/189 428/40.1 |
| 2010/0008090 | A1 | 1/2010 | Li | |
| 2011/0115407 | A1 | 5/2011 | Wibben et al. | |
| 2011/0157891 | A1* | 6/2011 | Davis | F21V 17/101 362/244 |
| 2012/0120644 | A1* | 5/2012 | Rieger | F21S 4/00 362/219 |
| 2012/0139446 | A1 | 6/2012 | Koren et al. | |
| 2012/0326613 | A1 | 12/2012 | Liu | |
| 2013/0020951 | A1 | 1/2013 | Pollock et al. | |
| 2013/0063035 | A1 | 3/2013 | Baddela | |
| 2013/0082615 | A1 | 4/2013 | Williams et al. | |
| 2014/0001972 | A1 | 1/2014 | Harris | |
| 2014/0015420 | A1 | 1/2014 | Liscinsky | |
| 2014/0015425 | A1 | 1/2014 | Kraft | |
| 2014/0049189 | A1 | 2/2014 | Ter Weeme et al. | |
| 2014/0210357 | A1 | 7/2014 | Yan et al. | |
| 2014/0265902 | A1 | 9/2014 | Yang et al. | |
| 2014/0300289 | A1 | 10/2014 | Zhu | |
| 2014/0333216 | A1 | 11/2014 | Zhang | |
| 2016/0157318 | A1* | 6/2016 | Yadav | H05B 47/105 315/151 |
| 2016/0165681 | A1 | 6/2016 | Nankil | |
| 2016/0178173 | A1 | 6/2016 | Yadav | |
| 2018/0080616 | A1* | 3/2018 | Elwell | F21S 4/28 |

* cited by examiner

LIGHT BOARD FOR LIGHTING FIXTURE

RELATED APPLICATIONS

This application is a continuation of U.S. patent application Ser. No. 15/963,350, filed Apr. 26, 2018, which claims the benefit of U.S. Provisional Patent Application No. 62/501,903, filed May 5, 2017, the entire contents of which are hereby incorporated by reference.

FIELD

The present disclosure relates generally to light boards (e.g., light emitting diode (LED) light boards) for use in lighting fixtures.

BACKGROUND

LED lighting systems can include one or more LED devices that become illuminated as a result of the movement of electrons through a semiconductor material. LED devices are becoming increasingly used in many lighting applications and have been integrated into a variety of products, such as light fixtures, indicator lights, flashlights, and other products. LED lighting systems can provide increased efficiency, life and durability, can produce less heat, and can provide other advantages relative to traditional incandescent and fluorescent lighting systems. Moreover, the efficiency of LED lighting systems has increased such that higher power can be provided at lower cost to the consumer.

SUMMARY

Aspects and advantages of embodiments of the present disclosure will be set forth in part in the following description, or may be learned from the description, or may be learned through practice of the embodiments.

One example aspect of the present disclosure is directed to a light board for a light fixture. The light board includes a first layer having a first surface and an opposing second surface. The light board includes one or more light emitting elements disposed on the first surface of the first layer. The light board includes one or more circuit elements located on the second surface of the first layer. The one or more circuit elements are associated with powering the one or more light emitting elements. The light board includes a second layer disposed on the second surface of the first layer such that the one or more circuit elements are located between the second surface of the first layer and the second layer.

Another example aspect of the present disclosure is directed to a lighting fixture. The lighting fixture includes a heat sink and a light board coupled to the heat sink. The light board includes a first layer having a first surface and an opposing second surface. The lighting fixture includes one or more light emitting elements disposed on the first surface of the first layer. The lighting fixture includes one or more circuit elements located on the opposing second surface of the first layer. The one or more circuit elements can be associated with powering the one or more light emitting elements. The lighting fixture includes a second layer having a first surface and an opposing second surface. The first surface of the second layer is disposed on the opposing second surface of the first layer such that one or more circuit elements are located between the opposing second surface of the first layer and the first surface of the second layer. The opposing second surface of the second layer can be coupled to the heat sink.

Yet another example aspect of the present disclosure is directed to a light emitting diode (LED) light engine. The LED light engine includes a first layer having a first surface and an opposing second surface. The LED light engine includes a first LED array disposed on the first surface of the first layer. The LED light engine includes a second LED array disposed on the first surface of the first layer. The first LED array and the second LED array each include one or more LED devices. The LED light engine includes one or more circuit elements located on the opposing second surface of the first layer. The one or more circuit elements can be associated with powering the first LED array and the second LED array. The LED light engine includes a second layer disposed on the opposing second surface of the first layer such that the one or more circuit elements are located between the opposing second surface of the first layer and the second layer. The one or more circuit elements can form at least a part of a current splitter circuit for controlling a driving current ratio between the first LED array and the second LED array.

Other example aspects of the present disclosure are directed to systems, methods, apparatus, circuits, lighting fixtures, light engines, lighting systems, etc.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
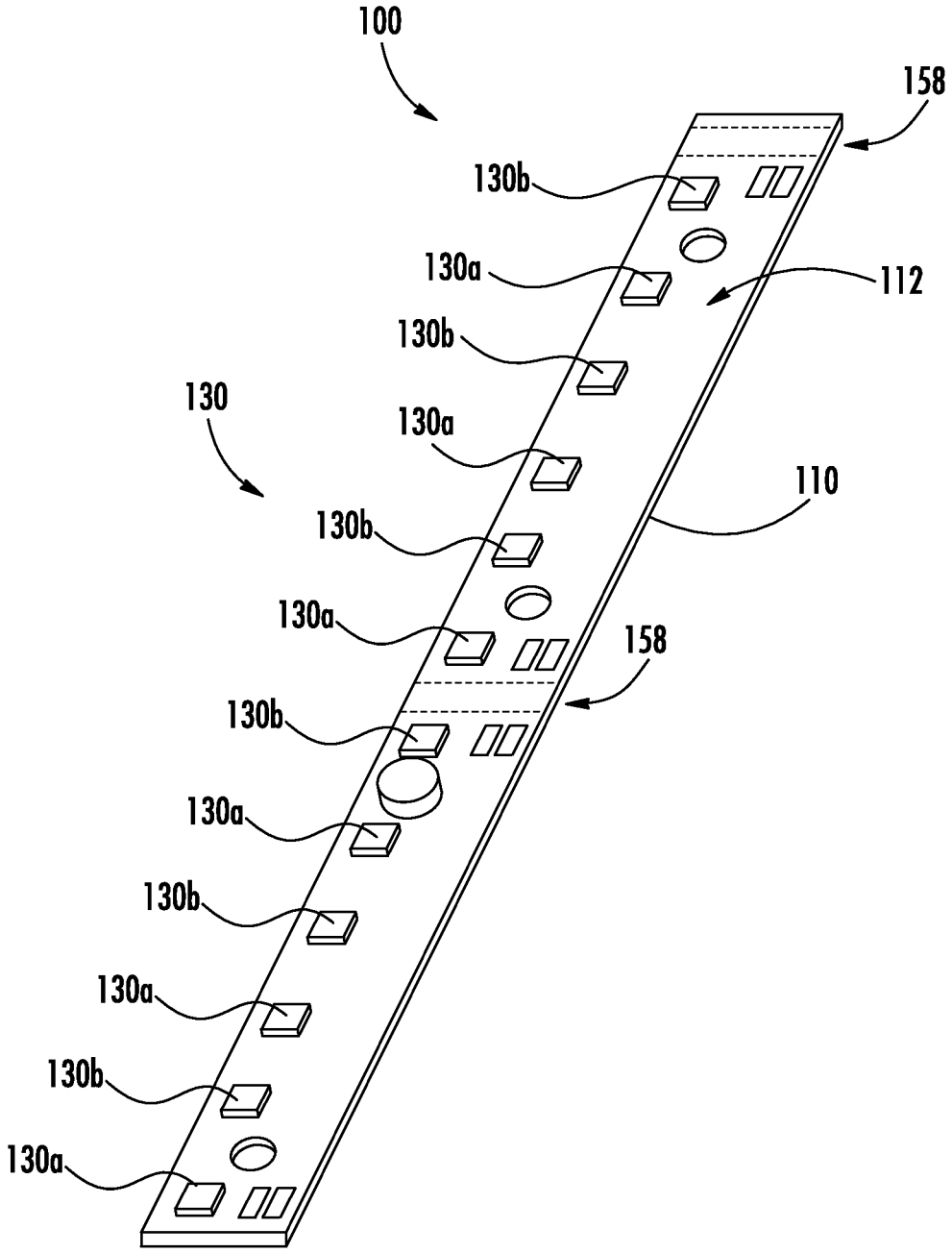
FIG. 1 depicts a perspective view of an example light board for a lighting fixture according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to a light board for use in a lighting system. Lighting fixtures can include one or more light boards or light engines as light sources for providing illumination in a space. In some instances, the light board(s) can include one or more light emitting diode (LED) devices or other solid state devices that are configured to emit light as a result electrons moving through a semiconductor material. Aspects of the present disclosure are discussed with reference to LED devices for purposes of illustration and discussion. Those of ordinary skill in the art, using the disclosures provided herein, will understand that other light emitting elements (e.g., other solid state light emitting elements) can be used without deviating from the scope of the present disclosure.

In some embodiments, a light board (e.g., a light engine) can include a plurality of LEDs to provide a desired light output. For instance, the light board can include multiple LED arrays. The LED arrays can be associated with different color temperatures and/or monochromatic colors. The color temperature of an LED device provides a measure of the color of light emitted by the LED device. For instance, the color temperature can refer to the temperature of an ideal black body radiator that radiates light of comparable hue to the LED device. LED devices associated with higher color temperatures can provide a more bluish color, whereas LED devices associated with lower color temperatures can provide a more reddish color. The light emitted by the different LED arrays can be controlled to provide a desired overall light output for the lighting system (e.g., using a current splitter circuit, dim-to-warm circuit, or other circuit).

Due to the number of LED arrays on the light board, circuit elements for powering the LEDs (e.g., circuit traces for delivering driving current) may have to be disposed on an opposing surface of the light board relative to the LED arrays. For instance, the circuit elements may have to be disposed on a bottom surface of the light board. This can make it difficult to secure the light board to a lighting fixture. For instance, securing the light board directly to a conductive heat sink without insulating adhesive materials can result in shorting of the circuit elements.

According to example embodiments of the present disclosure, a light board can include a first layer (e.g., FR4 material) having a first surface and an opposing second surface. One or more light emitting elements (e.g., a plurality of LED arrays) can be disposed on the first surface of the first layer. Circuit elements for powering the one or more light emitting elements (e.g., circuit traces for delivering driving current) can be disposed on the second surface of the first layer. The light board can include a second layer disposed on the second surface of the first layer such that the circuit elements are disposed between the second surface of the first layer and the second layer. The second layer can be an insulating material (e.g., FR4). The light board can be laminated together to provide a unitary structure. The light board can be secured to a lighting fixture such that the second layer is in contact with the heat sink of the lighting fixture. The second layer can be secured to the heat sink using, for instance, an adhesive. In this manner, the light board can be more easily secured and assembled into the lighting fixture without shorting or otherwise interfering with the circuit elements for powering the light emitting elements.

FIG. 1 depicts a perspective view of a portion of an example light board 100 according to example embodiments of the present disclosure. The light board 100 includes a plurality of LED devices 130. The LED devices 130 are disposed on a first surface 112 (e.g., a top surface) of a first layer 110 of the light board 100. Each LED device 130 can be configured to emit light as a result of electrons moving through a semiconductor material.

The LED devices 130 can include a plurality of LED devices 130*a* associated with a first array of LED devices and a plurality of LED device 130*b* associated with a second array of LED devices. In some embodiments, the plurality of LED devices 130*a* associated with the first array and the plurality of LED devices 130*b* associated with the second array can be associated with different color temperatures, different monochromatic colors, different brightness, or other lighting characteristics. As will be discussed in detail below, the driving current provided to the plurality of LED devices 130*a* in the first array and the plurality of LED devices 130*b* in the second array can be controlled (e.g., using a dim-to-warm circuit, a current splitter circuit, etc.) to provide a desired lighting effect.

In some example embodiments, the light board 100 can include perforations 158 to facilitate breaking or severing portions of the light board 100 from adjacent portions. The perforations 158 may be formed, for instance, by a series of small holes. In this way, the light board 100 can include a plurality of strips that are arranged together in a linear manner. Portions of the light board 100 can be easily detached to provide a light board 100 of a suitable length for a lighting fixture.

Figure 2:
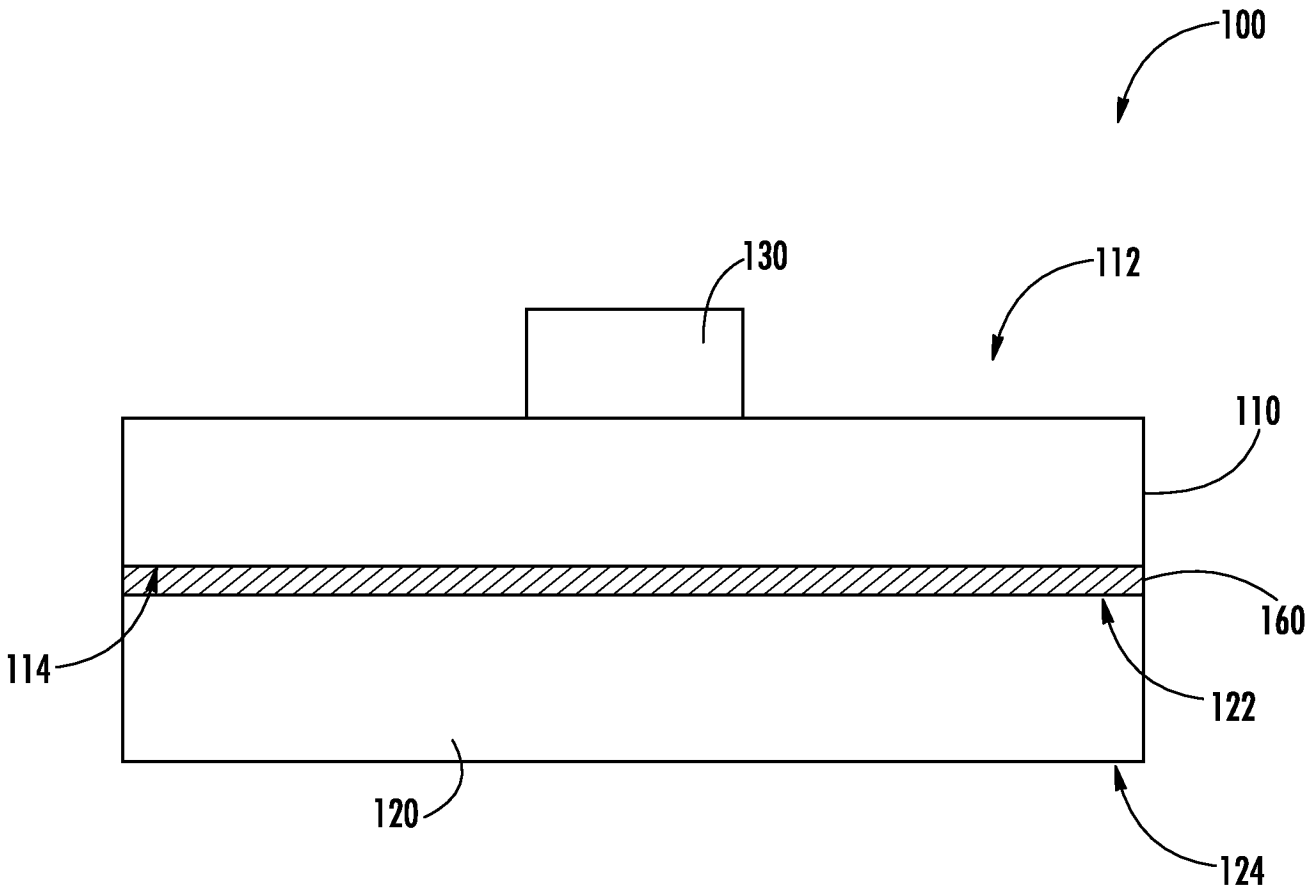
FIG. 2 depicts a cross-sectional view of an example light board for a lighting fixture according to example embodiments of the present disclosure.

FIG. 2 depicts a cross-sectional view of an example light board 100 according to example embodiments of the present disclosure. As shown, the light board 100 includes a first layer 110. The first layer 110 can include an insulating material, such as FR4. The first layer 110 can include a first surface 112 and an opposing second surface 114. LED device(s) 130 can be disposed on the first surface 112. As discussed above, a plurality of LED devices 130 associated with different LED arrays (e.g., a first array and a second array) can be disposed on the first surface 112.

Figure 3:
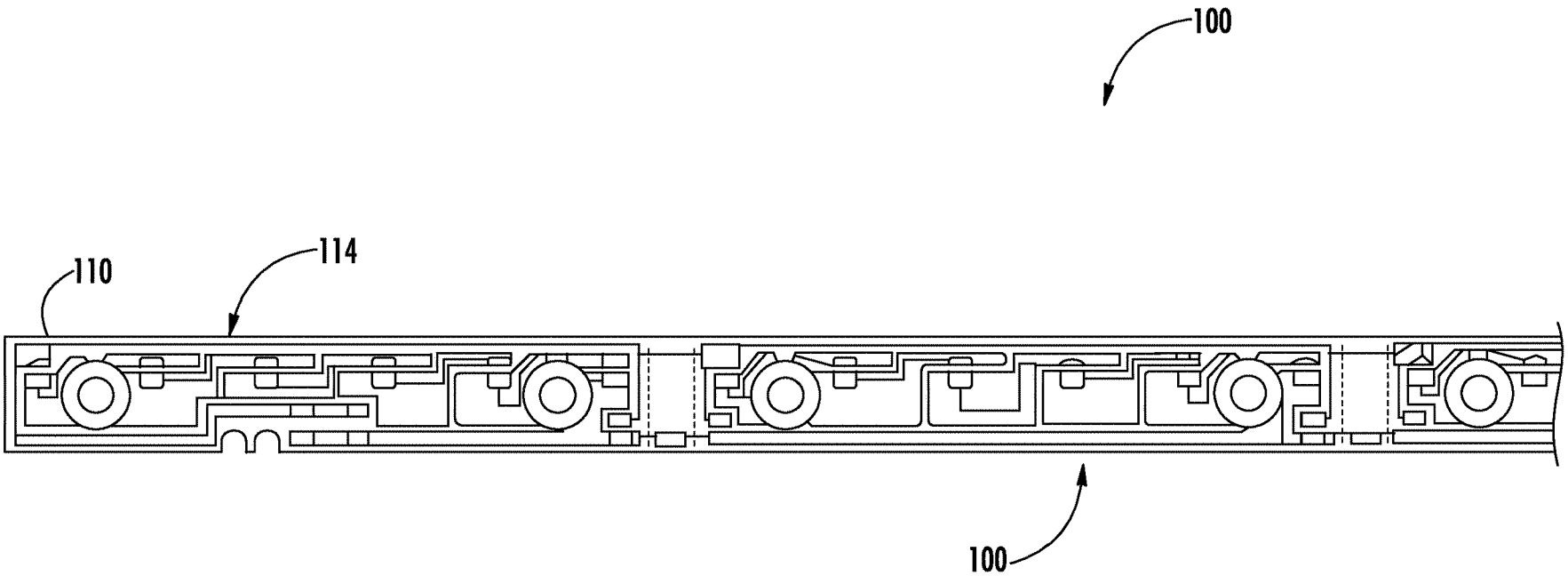
FIG. 3 depicts a view of a circuit elements located on a second surface of the first layer of the light board according to example embodiments of the present disclosure.

The light board 100 can include one or more circuit elements 160 located on the second surface 114 of the first layer 110. The circuit elements 160 can be associated with powering the LED device(s) 130. For instance, the circuit elements 160 can include traces for delivering power (e.g., from a driver, current splitter, dim-to-warm circuit, or other source) to the LED device(s) 130. In some embodiments, the circuit elements 160 can be printed on the second surface of the first layer 110. FIG. 3 depicts a plan view of example circuit elements 160 printed on a second surface of a first layer 160 of the light board 100 according to example embodiments of the present disclosure.

Referring to FIG. 2, the light board 100 includes a second layer 120 of insulating material. The second layer 120 can include, for instance, an FR4 material. The second layer 120 can include a first surface 122 and an opposing second surface 124. The second layer 120 can be disposed relative to the second surface 114 of the first layer 110 such that the one or more circuit elements 160 are located between the second surface 114 of the first layer 110 and the first surface 122 of the second layer 120. The first layer 110, second layer 120, and circuit elements 160 can be laminated together to form a unitary structure.

The second layer 120 can facilitate assembly of the light board 100 into a lighting fixture. For instance, the light board 100 can be coupled directly to a heat sink of the lighting fixture. The second layer 120 can electrically insulate the circuit elements 160 from conductive contact with the heat sink.

Figure 4:
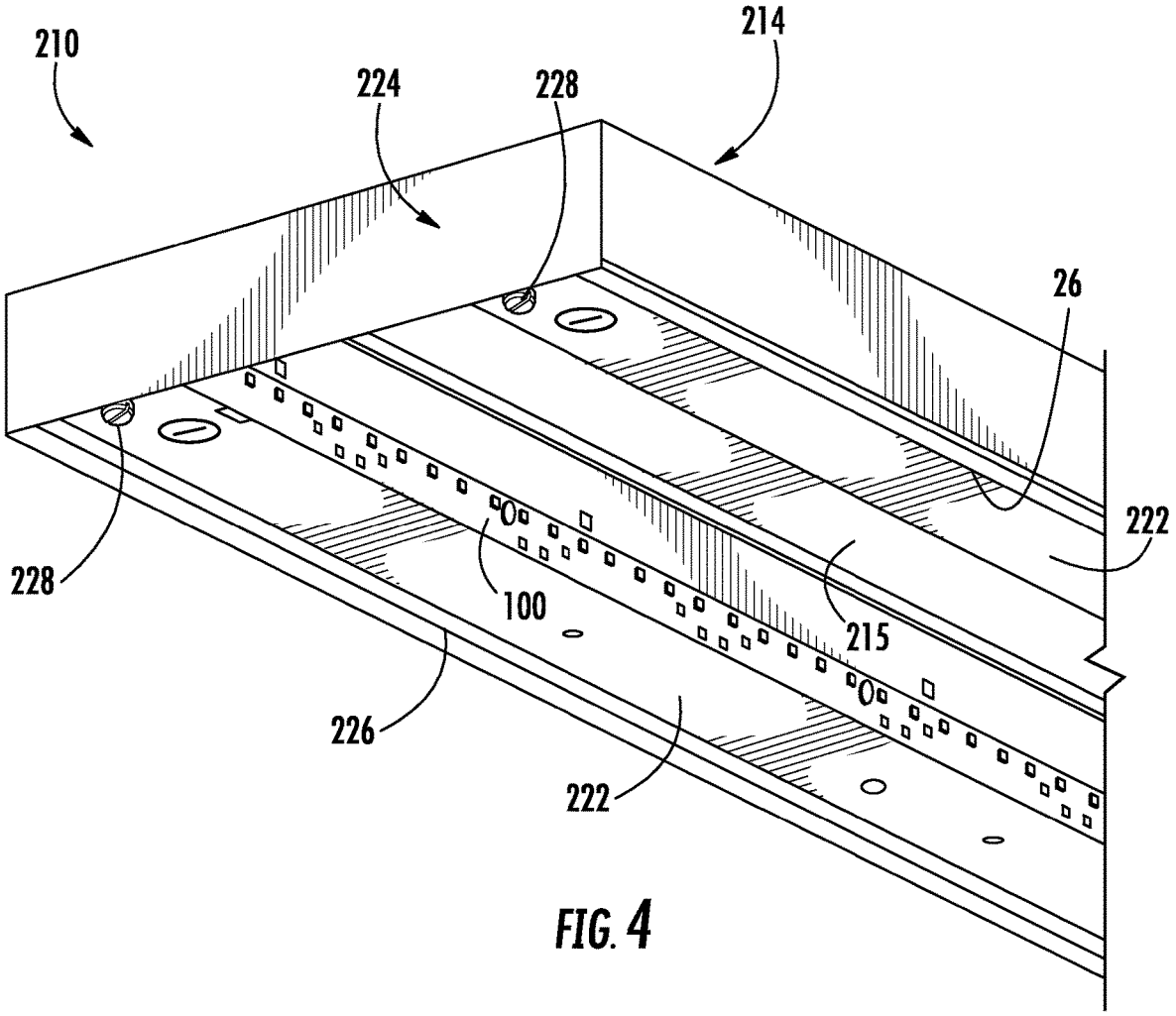
FIG. 4 depicts a perspective view of a portion of an example lighting fixture including a light board according to example embodiments of the present disclosure.
Figure 5:
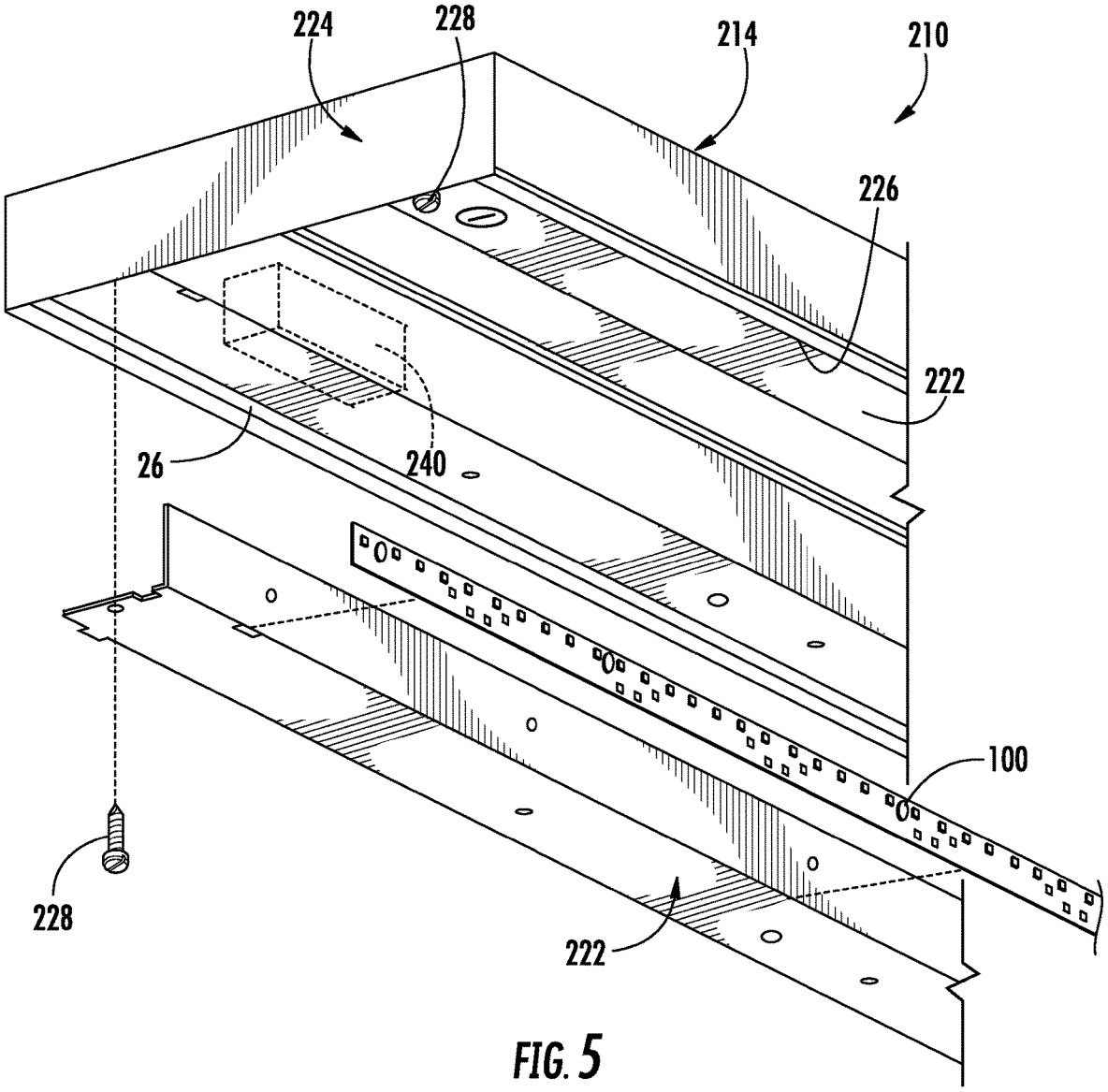
FIG. 5 depicts an exploded view of a portion of an example lighting fixture according to example embodiments of the present disclosure.

More particularly, FIGS. 4 and 5 illustrate a portion of a light fixture 210. In some embodiments, the light fixture 210 can be used in a commercial or industrial environment. The fixture 210 can include a housing 214, a reflector 215 positioned within the housing 214, and a bracket 222 coupled to the housing 214. The bracket 222 can serve as a heat sink for the light board 100. In the illustrated embodiment, the housing 214 includes an end 224 and a pair of side surfaces 226. Only one end 224 is shown in FIGS. 4 and 5, but it is understood that a similar end is positioned at the other end of the housing 214. In some embodiments, the housing 214 can be secured to a ceiling. Each of the housing 214 and/or the reflector 216 may have a different shape than illustrated in FIGS. 4 and 5 without deviating from the scope of the present disclosure.

The bracket 222 can be secured to the housing 214 (e.g., by one or more fasteners 228). The housing 214 and bracket 222 support a light board 100. The bracket 222 can serve as a heat sink for the light board 100. A second surface 124 of a second layer 120 of insulating material for the light board 100 can be directly coupled to the bracket 222.

As shown, the light fixture 210 can further include a driver 290 as well as other circuit components (not shown) for providing power to the light board 100. The light board 100 can deliver power to LED devices 130 disposed on the light board 100 through circuit elements (e.g., conductive traces) disposed between a first layer of insulating material 110 and a second layer of insulating material 120 of the light board 100. Example circuit components for powering the LED devices 130 disposed on the light board 100 will be discussed in detail with reference to FIGS. 6 and 7.

The fixture 210 may also include a lens (e.g., a refractor or diffuser—not shown) coupled to the housing 214, and the lens may extend between the ends 224 of the housing 214 and at least partially between the side surfaces 226 of the housing 214. The lens may cover the light board 100 to provide a desired light distribution for the light emitted by the LED devices 130. The lens may cover at least a portion of both the reflector 215 and the bracket 222.

Figure 6:
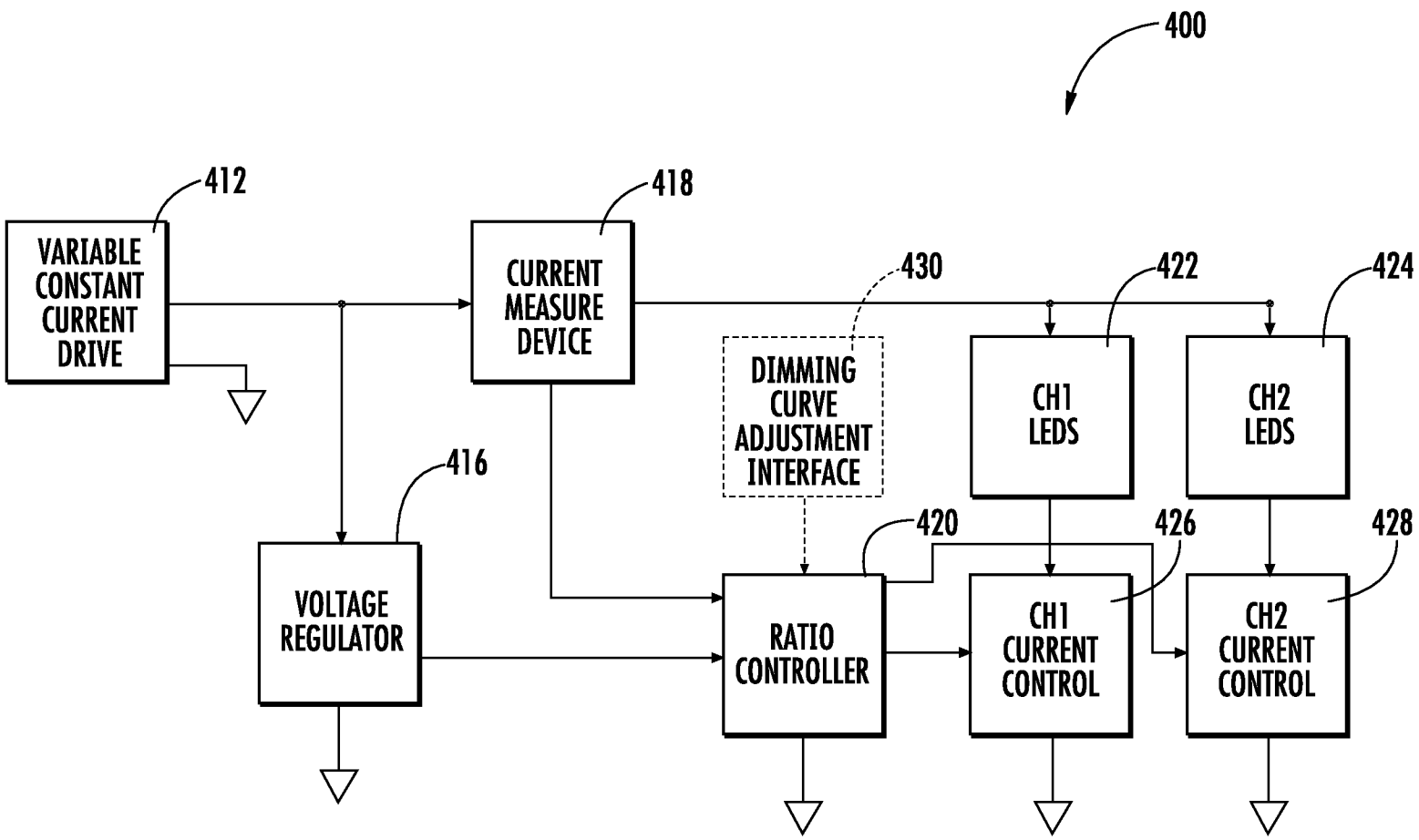
FIG. 6 depicts an example circuit for powering and controlling one or more light emitting elements, at least a portion of which may be included as part a light board according to example embodiments of the present disclosure.

FIG. 6 depicts a block diagram of an example dim-to-warm circuit 400 used to control the light output (e.g., color temperature) of the LED devices 130 of the light board 100 according to example embodiments of the present disclosure. The dim-to-warm circuit 400 can receive a current input from a variable constant current drive 412 (e.g. a driver, such as driver 290 illustrated in FIG. 5). The variable constant current drive 412 can output a direct current (DC). A dimming switch or other dimming adjustment device or mechanism can vary the magnitude of the DC current from about a 10% value to about 100% or maximum current output. The dimming adjustment device can be operated manually to adjust the DC current output. In some embodiments, a separate on/off switch disconnects power to the current drive 412.

A voltage regulator 416 can receive the input current from the current drive 412. A current measure device 418 can receive and measure the current output from the current drive 412 and can output a measured current value.

A controller 420, such as a ratio controller, can receive inputs from the voltage regulator 416 and the current measure device 418. The controller 420 can include one or more control devices, and can be a micro-controller, such as a microprocessor including a memory. In another embodiment, an application specific integrated circuit (ASIC) is contemplated. The controller 420 can be configured to process the measured current value and output current values as discussed in detail below.

A first light channel 422 and a second light channel 424 can receive the current output by the current drive 412. The first light channel 422 can be electrically connected in series to a first current control 426 whereby current passes through the first light channel 422 and the first current control 426. The first current control 426 receives a current value output by the controller 420. In one embodiment, the first current control 426 is a gated transistor and the current value is provided to the gate of the transistor.

The second light channel 424 is electrically connected in series to a second current control 428 whereby current passes through the second light channel 424 and the second current control 428. The second current control 428 also receives a current value output by controller 420. In one embodiment, the second current control 428 is a gated transistor and the current value is provided to the gate of the transistor.

In some embodiments, the first light channel 422 can provide power to the plurality of LED devices 130*a* connected in series on the light board 100 as part of the first LED array. The second light channel 424 can provide power to the plurality of LED devices 130*b* connected in series on the light board 100 as part of the second LED array. The first light channel 422 and the second light channel 424 are provided in parallel as shown in FIG. 6. At least a portion of the first light channel 422 and the second light channel 424 can be implemented as conductive traces as part of circuit elements 160 on the light board 100.

An optional dimming curve adjustment interface 430 is provided to communicate with the controller 420 to adjust a dimming curve for the combination of light channels that is stored in the controller 420. In one embodiment, the dimming curve adjustment interface 430 is a Bluetooth wireless device for wireless communication with the controller 420. In other embodiments, the dimming curve adjustment interface 430 is a resistor that connects to pins of a processor of the controller 420. Other arrangements are contemplated and within the scope of the present disclosure.

The voltage regulator 416 can receive a small or negligible portion of the current output from the current drive 412. The voltage regulator 416 can output a small voltage to the controller 420 to power the controller 420. The voltage regulator 416 can be configured so that adequate voltage is provided to power the controller 420 even if the current from the current drive is less than 10% of its maximum current value, and even less than 5% or other suitable threshold in some embodiments.

In operation, the constant DC current that is output by the current drive 412 can be adjusted. The current output by the current drive 412 can be input to the first light channel 422 and the second light channel 424. The controller 420 can receive a measured current value obtained by the current measuring device 418. The controller 420 can compare the measured current value to a maximum current value for the current drive 412 to calculate or otherwise determine a light control value. In some embodiments, the light control value can be a percentage light control value from about 0% to about 100%.

The controller 420 can determine a ratio of current provided to the first light channel 422 relative to the second light channel 424. More specifically, the controller 420 determines how much of the current output by the current drive is provided to each of the light channels 422, 424.

A memory (not shown) provided with the controller 420 can store proportional current values for each of the light channels 422, 424 that correspond to a given percentage light control value. The controller 420 can use the percentage light control value to obtain a current value or percentage for light to be output by the first light channel 422 and a current value or percentage for light to be output by the second light channel 424. Upon the determination of the current values, the controller 420 sends a first current value for applying a first current to the first current control 426 and a second current value for applying a second current to the second current control 428. Thus, the first current is based on the first current value and the second current is based on the second current value. Changing the values of the first current and the second current result in different desired correlated color temperatures for the light output at different ones of the percentage light control values.

Figure 7:
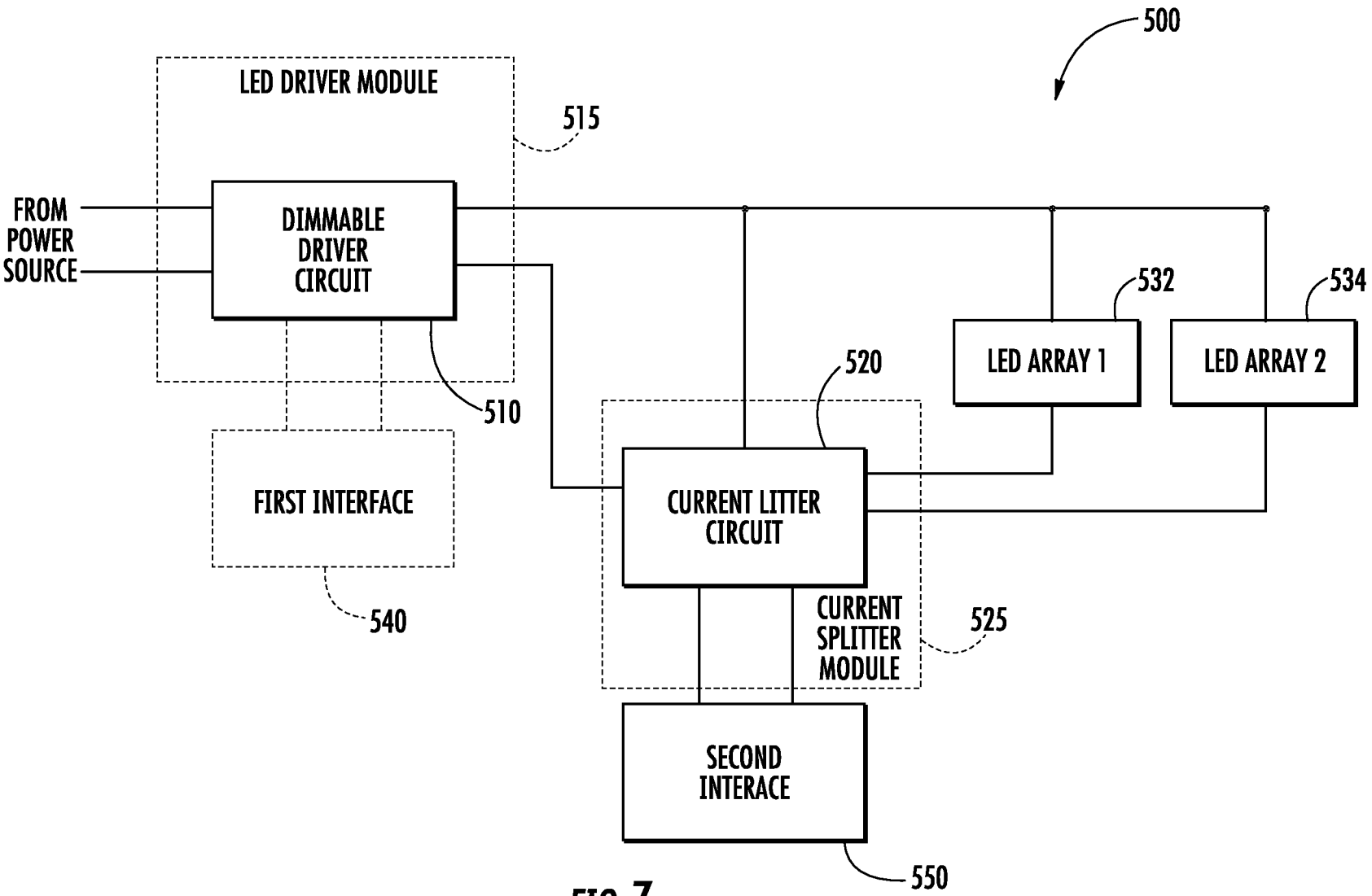
FIG. 7 depicts an example circuit for powering and controlling one or more light emitting elements, at least a portion of which may be included as part a light board according to example embodiments of the present disclosure.

In another embodiment, a current splitter circuit can be used to control the light output (e.g., color temperature) of the LED devices of the light board 100 according to example embodiments of the present disclosure. FIG. 7 depicts a block diagram of an example current splitter system 500 used to control the color temperature of the first light source(s) 140 according to example embodiments of the present disclosure.

The current splitter system 500 can include an LED driver module 515 (e.g. driver 290 of FIG. 5), a current splitter module 525, and a plurality of LED arrays (channels), including a first LED array 532 and a second LED array 534. At least a portion of the conductors used to deliver power to the first LED array 532 and the second LED array 534 can be implemented as conductive traces as part of circuit elements 160 on the light board 100.

The LED driver module 515 can include a dimmable driver circuit 510. The current splitter module 525 can include a current splitter circuit 520. In the embodiment illustrated in FIG. 7, the LED driver module 515 can be disposed in a housing, circuit board, or other component that is separate from and/or external to the current splitter module 525. For instance, the current splitter module 525 can be a module external to the LED driver module 515 that is disposed in an electrical path between the LED driver module 515 and the plurality of LED arrays, such as the first LED array 532 and the second LED array 534.

The dimmable driver circuit 510 can be configured to receive an input power, such as an input AC power or an input DC power, and can convert the input power to a suitable driver output (e.g. driver current) for powering the plurality of LED arrays. In some embodiments, the dimmable driver circuit 510 can include various components, such as switching elements (e.g. transistors) that are controlled to provide a suitable driver output. For instance, in one embodiment, the driver circuit 510 can include one or more transistors. Gate timing commands can be provided to the one or more transistors to convert the input power to a suitable driver output using pulse width modulation techniques. In some embodiments, the dimmable driver circuit 510 can be a line dimming driver, such as a phase-cut dimmable driver, Triac dimmer, trailing edge dimmer, or other line dimming driver. The driver output can be adjusted using the line dimming driver by controlling the input power to the dimmable driver circuit.

In addition and/or in the alternative, a first interface 540 can be provided at the dimmable driver circuit 510 for receiving a dimming control signal used to control the driver output. The first interface 540 can include one or more components for communicating the dimming control signal to the dimmable driver circuit 510. For example, the first interface 540 can include one or more circuits, terminals, pins, contacts, conductors, or other components for communicating the dimming control signal to the dimmable driver circuit 510.

The dimming control signal can be provided from an external circuit, such as an external dimming circuit. The external circuit can include one or more devices, such as a smart dimming interface, a potentiometer, a Zener diode, or other device. In some embodiments, the dimming control signal can be a 0V to 10V dimming control signal, depending on the output of the external circuit. For instance, if a user manually adjusts a dimmer, the dimming control signal can be adjusted from, for instance, 0V to 5V. The dimming control signal can be implemented using other suitable protocols, such as a digital addressable lighting interface (DALI) lighting control signal, digital multiplex (DMX) lighting control signal, or other suitable protocol.

The driver circuit 510 can be configured to adjust the driver output based at least in part on the dimming control signal. For example, reducing the dimming control signal by 50% can result in a corresponding reduction in the driver output of about 50%. The reduction of the driver output can reduce the overall driver current for supply to the plurality of LED arrays. As a result, the light output of the plurality of LED arrays can be simultaneously adjusted (e.g. dimmed) by varying the dimming control signal.

As illustrated in FIG. 7, the driver output can be provided to a current splitter circuit 520. The current splitter circuit 520 can be configured to split the driver output into a first current for powering the first LED array 532 and a second current for powering the second LED array 534. In this way, the current splitter circuit 520 can be used to adjust the light output of the first LED array 532 relative to the light output of the second LED array 534. The current splitter circuit 520 can be configured to control the current ratio of the first current provided to the first LED array 532 to the second current provided to the second LED array based on a variable reference signal (e.g. a 0V to 10V lighting control signal).

More particularly, a second interface 550 at the current splitter circuit 120 can receive variable reference signal. The second interface 550 can include one or more components for communicating the variable reference signal to the current splitter circuit 520. For example, the second interface 550 can include one or more circuits, terminals, pins, contacts, conductors, or other components for communicating a variable reference signal to the current splitter circuit 520.

The variable reference signal can be provided from an external circuit, such as an external dimming circuit. The external circuit can include one or more devices, such as a smart dimming interface, a potentiometer, a Zener diode, or other device. The variable reference signal can be a 0V to 10V lighting control signal, depending on the output of the external circuit. If a user manually adjusts a dimmer, the variable reference signal can be adjusted from, for instance, 0V to 5V. The variable reference signal can be implemented using other suitable protocols, such as a DALI protocol, or a DMX protocol.

The current splitter circuit 520 can include one or more control devices (e.g. a microprocessor, a microcontroller, logic device, etc.) and one or more switching elements (e.g. transistors) in line with each of the first LED array 532 and the second LED array 534. The control device(s) can control the amount of current provided to the first LED array 532 and the second LED array 534 by controlling the switching elements. The switching elements used to control the amount of current provided to the first LED array 532 and to the second LED array 534 can be either on the low voltage side of the LED arrays or the high voltage side of the LED arrays.

In particular aspects, the control device(s) of the current splitter circuit can control the current provided to the first LED array 532 and to the second LED array 534 according to a current ratio control curve based on the variable reference signal. The current ratio control curve can be stored in firmware or stored in a memory accessible by the control device. The current ratio control curve can specify the current ratio of the first current provided to the first LED array 532 and the second current provided to the second LED array 534 as a function of at least the variable reference signal.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A light board for a light fixture, the light board comprising:
- a first layer having a first surface and an opposing second surface;
- a second layer having a first surface and an opposing second surface;
- one or more light emitting elements disposed on the first surface of the first layer;
- one or more circuit elements for powering the one or more light emitting elements disposed between the second opposing surface of the first layer and the first surface of the second layer.

2. The light board of claim 1, wherein the one or more light emitting elements are one or more light emitting diode (LED) devices.

3. The light board of claim 1, wherein the first surface of the second layer is disposed adjacent to the opposing second surface of the first layer.

4. The light board of claim 1, wherein the opposing second surface of the second layer is coupled to a heat sink.

5. The light board of claim 4, wherein the heat sink is removably secured to the light fixture.

6. The light board of claim 1, wherein the light board is removably secured to the light fixture by a bracket.

7. A light fixture comprising:
- a housing; and
- a light board that is removably secured to the housing, the light board including:
  - a first layer supporting one or more light emitting elements;
  - a second layer disposed adjacent to the first layer; and
  - one or more circuit elements for powering the one or more light emitting elements disposed between the first layer and the second layer.

8. The light fixture of claim 7, wherein the second layer is coupled to a heat sink.

9. The light fixture of claim 8, wherein the light board is removably secured to the housing by the heat sink.

10. The light fixture of claim 8, wherein the one or more circuit elements are electrically insulated from the heat sink.

11. The light fixture of claim 7, wherein the first layer includes a first surface and an opposing second surface;
- wherein the second layer includes a first surface and an opposing second surface; and
- wherein the one or more circuit elements are disposed between the opposing second surface of the first layer and the first surface of the second layer.

12. The light fixture of claim 11, wherein the opposing second surface of the second layer is coupled to a heat sink; and
- wherein the heat sink is removably secured to the housing by one or more fasteners.

13. A light board comprising:
- a first layer;
- a first light emitting diode (LED) array disposed on the first layer, the first LED array including one or more LED devices;
- a second LED array disposed on the first layer, the second LED array including one or more LED devices;
- a second layer disposed adjacent to the first layer; and
- one or more circuit elements disposed between the first layer and the second layer, the one or more circuit elements associated with powering the first LED array and the second LED array.

14. The light board of claim 13, wherein the one or more circuit elements form at least a part of a circuit for controlling a driving current ratio between the first LED array and the second LED array.

15. The light board of claim 14, wherein the circuit includes:
- a first current control electrically connected in series with the first LED array, the first current control configured to control a first amount of current provided to the first LED array; and
- a second current control electrically connected in series with the second LED array, the second current control configured to control a second amount of current provided to the second LED array.

16. The light board of claim 15, wherein the first current control is a first transistor and the second current control is a second transistor.

17. The light board of claim 13, wherein the first layer includes a first surface and an opposing second surface;
- wherein the first LED array and the second LED array are disposed on the first surface of the first layer; and
- wherein the one or more circuit elements are disposed adjacent opposing to the second layer.

18. The light board of claim 17, wherein the one or more circuit elements include:
- a first channel of one or more circuit traces provided on a first electrical path from a dim-to-warm circuit to the first LED array; and
- a second channel of one or more circuit traces provided on a second electrical path from a dim-to-warm circuit to the second LED array.

19. A light fixture comprising:
- a housing; and
- a light board secured to the housing, the light board including:
  - a first layer;

a first light emitting diode (LED) array disposed on the first layer, the first LED array including one or more LED devices;

a second LED array disposed on the first layer, the second LED array including one or more LED devices;

a second layer disposed adjacent to the first layer; and one or more circuit elements disposed between the first layer and the second layer, the one or more circuit elements associated with powering the first LED array and the second LED array.

20. The light fixture of claim 19, wherein the one or more circuit elements form at least a part of a circuit for controlling a driving current ratio between the first LED array and the second LED array.

21. The light fixture of claim 20, wherein the circuit includes:

a first current control electrically connected in series with the first LED array, the first current control configured to control a first amount of current provided to the first LED array; and a second current control electrically connected in series with the second LED array, the second current control configured to control a second amount of current provided to the second LED array.

22. The light fixture of claim 21, wherein the first current control is a first transistor and the second current control is a second transistor.

23. The light fixture of claim 19, wherein the second layer is removably secured to the housing by a heat sink.

24. The light fixture of claim 19, wherein the one or more circuit elements include:

a first channel of one or more circuit traces provided on a first electrical path from a dim-to-warm circuit to the first LED array; and a second channel of one or more circuit traces provided on a second electrical path from a dim-to-warm circuit to the second LED array.

* * * * *